US006152858A

United States Patent [19]

Kolb

[11] Patent Number: 6,152,858

[45] Date of Patent: Nov. 28, 2000

[54] HAND, WRIST AND FOREARM EXERCISE DEVICE

[76] Inventor: Mark Kolb, 7430 Hogan Rd., Jacksonville, Fla. 32216

[21] Appl. No.: 09/268,870

[22] Filed: Mar. 16, 1999

[51] Int. Cl.[7] ..... A63B 23/14

[52] U.S. Cl. ..... 482/44; 482/94; 482/97; 482/100; 482/45; 482/50

[58] Field of Search ..... 482/92–93, 148, 482/44, 45, 50, 90, 95, 94, 97, 100; 248/125.7, 125.8, 126, 127, 132, 130.1, 425, 108–110

[56] References Cited

U.S. PATENT DOCUMENTS 4,838,542 6/1989 Wilkinson ..... 272/67

*Primary Examiner*—Jerome W. Donnelly
*Assistant Examiner*—Lori Baker Amerson
*Attorney, Agent, or Firm*—Thomas C. Saitta

[57] ABSTRACT

An exercise device for the hands, wrists and forearms comprising an externally threaded, vertically oriented inner post member and an outer sleeve member coaxially mounted thereon in a rotatable and telescoping manner, where the outer sleeve supports a number of interchangeable weight disks and the outer sleeve member is raised and lowered relative to the inner post member by rotation of the outer sleeve member. Outer sleeve member is connected to an internally threaded bearing nut containing a plural number of ball bearings, the ball bearings being retained by external threading on said inner post member.

13 Claims, 2 Drawing Sheets

HAND, WRIST AND FOREARM EXERCISE DEVICE

BACKGROUND OF THE INVENTION

This invention relates generally to the field of exercise devices which involve weights, and more particularly to such devices which are used to strengthen the hands, wrist and forearms. Such devices may be used to increase muscle mass or for rehabilitation and therapeutic purposes. In particular, the invention involves an exercise device having weights supported on a vertically oriented, rotatable sleeve member where the user raises and lowers the weights by rotating the sleeve member.

Exercise equipment has evolved from basic barbells and dumbbells, where weight disks are mounted on each end of a rod, to devices specifically designed to work certain muscles or muscle groups. Some devices still utilize interchangeable free weights incorporated with gears, cams, pulleys, etc., while others make use of tension members such as springs, elastic bands or the like. The invention concerns strengthening the hands, wrists and forearms. Examples of prior art devices which address this object include U.S. Pat. No. 3,184,234 to Struble, which discloses a hand-held device comprising a pair of cylindrical grips mounted coaxially with a friction member inserted therebetween, the grips being rotatable in opposing directions. End members may be tightened in the axial direction to increase or decrease the resistance. Another such device is seen in U.S. Pat. No. 3,396,967 to Brown, the device comprising a pair of cylindrical grips which are joined by a helical spring, where twisting the grips in opposing directions tightens or loosens the biasing force induced by the spring. More recently issued patents such as U.S. Pat. No. 4,643,417 to Nieman, U.S. Pat. No. 4,695,049 to Ciemiega, U.S. Pat. No. 4,838,542 Wilkinson and U.S. Pat. No. 5,690,598 to Liang show improvements in the Struble device. These devices all lack the ability to significantly vary the weight or resistance of the device, and being hand-held devices are subject to unintentionally working other muscle groups which can reduce the effectiveness of the exercise or possibly cause injury.

It is an object of this invention to provide an exercise device directed at strengthening the hand, wrist and forearm muscles and muscle groups, where the device utilizes free weights so that the amount of weight, and thus the amount of resistance, can be adjusted as desired. It is a further object to provide such a device which is supported by a base such that the device remains in a fixed location during the exercise. These and other objects not expressly stated will become apparent from the disclosure below.

SUMMARY OF THE INVENTION

The invention is an exercise device for strengthening the muscles in the hands, wrists and forearms. The device comprises in general a base member for supporting the device on a flat surface, an externally threaded, vertically oriented inner post member connected in fixed manner to the base member, and an outer sleeve member which is mounted in a rotatable and telescoping manner onto the inner post member. The outer sleeve member has a post extending from its upper end which receives weight disks and is connected to a bearing nut at its lower end. The bearing nut is internally threaded and contains a plurality of ball bearings, such that the ball bearings are retained between the bearing nut and the external threading of the inner post member. Rotation of the outer sleeve member relative to the stationary inner post member causes it to extend upward or retract downward.

Increasing or decreasing the total weight of the weight disks placed onto the outer sleeve member correspondingly increases or decreases the amount of force required to raise the outer sleeve member or to resist the downward effects of gravity on the outer sleeve member.

DETAILED DESCRIPTION OF THE INVENTION

Figure 1:
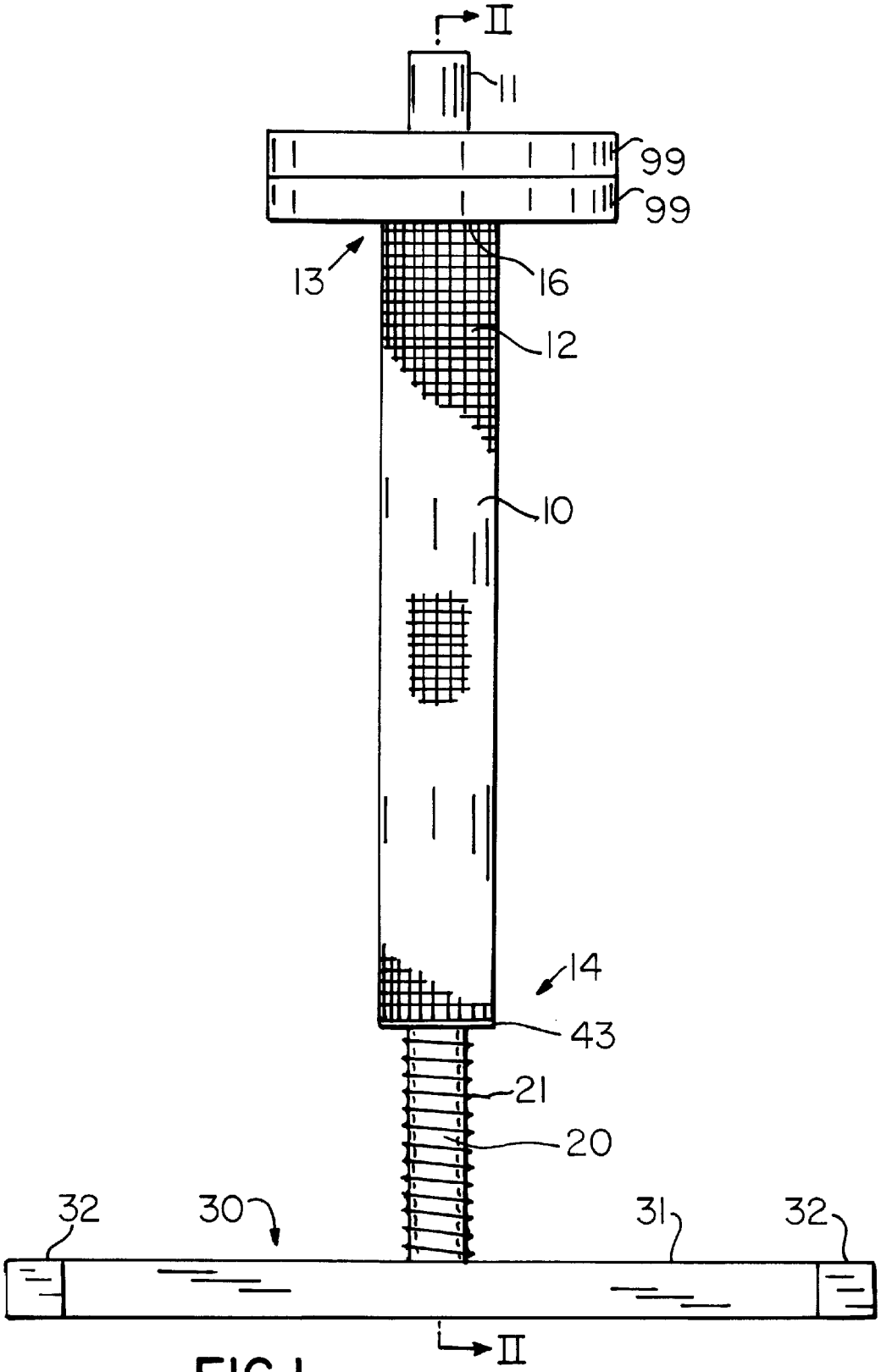
FIG. 1 is a side view of the device.
Figure 2:
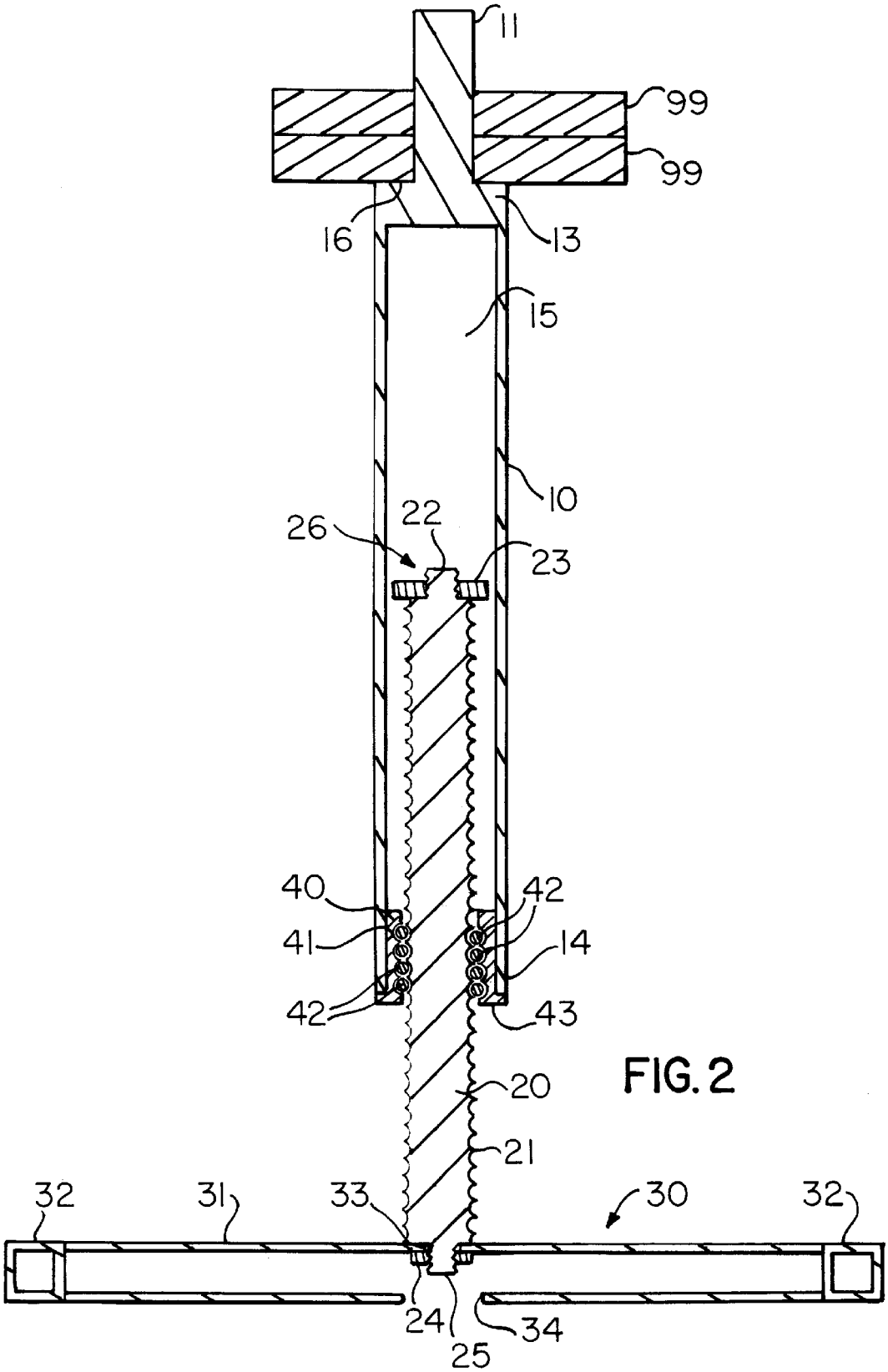
FIG. 2 is a cross-sectional view of FIG. 1 taken along line II—II.

With reference to the drawings, the invention will now be described in detail with regard for the best mode and the preferred embodiment. Preferably, the device is primarily fabricated from metal, although other suitably strong and rigid materials could be substituted. In general, as shown in the figures, the invention is an exercise device for the hands, wrists and forearms comprising a base member 30 to which is connected a vertically oriented inner post member 20, onto which is rotatably and telescopically mounted an outer sleeve member 10 configured to receive one or more weight disks 99.

The base member 30 provides the means to support the inner post member 20 and outer sleeve member 10 in a generally vertical manner, such that the device is remains stable and fixed in location during use. Base member 30 may comprise any suitable structure to accomplish this goal, including being another piece of exercise equipment or a mounting directly into the floor, but as shown preferably comprises a member having a relatively wide footprint for stability but which allows the device to be moved to different locations. The drawings show a base member 30 comprising a cross member 31 the ends of which are each joined to the midpoint of a lateral member 32 to define an I- or H-shaped base member 30. Lateral member 32 could also be bridged to raise the base above the support surface. The cross member 31 and lateral members 32 may be composed of square-profile tubing, and are preferably joined by welding. A post aperture 33 is provided in the center of the cross member 31 to receive the inner post member 30, with a nut aperture 34 placed underneath the post aperture 33 for secure attachment of the inner post member 20 to the base member 30 using a locking nut 24. Alternatively, inner post member 10 could be attached to base member 30 by welding or equivalent means.

Inner post member 10 comprises an elongated cylinder which has external threading 21 in a helical configuration. A threaded mounting pin 25 of smaller diameter extends below the inner post member 30 and is inserted into the post aperture 33 of base member 30. Locking nut 24 is threaded onto the mounting pin 25 to secure inner post member 20 to the base member 30 in a generally vertical position. A threaded top pin 22 of lesser diameter extends from the upper end of the inner post member 20 and receives a detent nut 23, the detent nut having a diameter greater than the inner post member 20. Preferably the diameter of the detent nut 23 is close to the interior diameter of the outer sleeve member 10, such that the detent nut 23 assists in maintaining the outer sleeve member 10 coaxially aligned with the inner post member 20. The combination of the top pin 22 and detent nut 23 define a detent means 26 to halt extension of the outer sleeve member 10 relative to the inner post member 20 at a certain point. Alternative constructions for the detent means 26 are possible, such as an attached shoulder or flange member, a horizontally oriented pin member inserted through the inner post member 20, a bolt or bolt with washer inserted axially into the inner post member 20, etc. The external threading 21 of inner post member 20 preferably has a semi-circular cross-sectional configuration to better receive the ball bearings 42 of the bearing nut 40, as described below.

The outer sleeve member 10 is sized to fit over and receive the inner post member 20 in coaxial alignment, and comprises a upper end 13 having a weight receiving means 11, such as a post, and shoulder 16, a lower end 14 attached to the bearing nut 40 and an open interior 15. The weight receiving post 11 receives the commonly known weight disks 99 having a central opening, such that multiple disks 99 of differing weights may be placed atop the shoulder 16 of outer sleeve member 10 and interchanged in a simple manner. The outer surface of the outer sleeve member 10 is preferably provided with gripping means 12, which may comprise patterns etched or embossed on the outer sleeve member 10 to create a knurled surface, or materials affixed to the surface to reduce slippage, or any other suitable means to increase grip.

The lower end of the outer sleeve member 10 is connected to a bearing nut 40, such as by attachment to flange 43 on the lower end of bearing nut 40. Bearing nut 40 has helical internal threading 41 corresponding in pitch and size to the external threading 21 of the inner post member 20. The bearing nut 40 extends a sufficient distance axially to encase a plural number of successive threads 21, and a plural number of ball bearings 42 are interspaced between the internal threading 41 of the bearing nut 40 and the external threading 21 of the inner post member 20. The ball bearings 42 maintain the outer sleeve member 10 and inner post member 20 in coaxial alignment, and provide the bearing surfaces which transfer the weight of the weight disks 99 from the outer sleeve member 10 to the inner post member 20. While it is possible to provide the outer sleeve 10 with internal threading and to mount it directly onto the inner post member 20 such that the threads contact, this is not preferred since the friction between the members will rapidly deteriorate the threads, even if configured with a square profile, leading to mechanical failure of the device. The ball bearings 42 safely transfer the force with greatly reduced friction, to the point that gravity alone will cause the outer sleeve member 10 to rotate downward onto the inner post member 20 under its own weight. A representative bearing nut 40 is that produced by Nook Industries, Inc., under the brand name POWER-TRAC, where the nut 40 is provided with an external chase which allows the ball bearings 42 to cycle through the nut 40 as it is turned on inner post member 20.

The device may be used in two ways. With the outer sleeve member 10 in the lowest position, the user grasps the outer sleeve with both hands, one positioned above the other, and rotates the sleeve in the direction to extend the outer sleeve member 10 upwardly by alternately gripping and flexing the wrist with each hand. This motion may be continued until the bearing nut 40 reaches the detent nut 23 and further upward movement is precluded. At this point the user then resists the gravitational pull on the outer sleeve member 10 by again alternately gripping and releasing the outer sleeve member 10 with both hands. Repetition of this exercise with different weight effectively strengthens the muscles of the hands, wrists and forearms.

It is preferred that the length of the outer sleeve member 10 be chosen such that its lower end 14 does not contact the base 30 in the lowermost position. This insures that a user's fingers will not be crushed between the outer sleeve member 10 and the base 30. Alternatively, an external protective sleeve or boot member, not shown, may be affixed to the base 30 surrounding the inner post member 20 and the outer sleeve member 30, with the protective sleeve or boot extending vertically sufficient distance such that the lower end 14 of the outer sleeve member 10 is not exposed even in the most extended configuration.

It is understood that equivalents and substitutions for certain elements set forth above may be obvious to those skilled in the art, and thus the true scope and definition of the invention is to be as set forth in the following claims.

I claim:

1. An exercise device for exercising the muscles of the hands, wrists and forearms, the device comprising a base member, a vertically oriented inner post member attached to said base member, said inner post member having external threading, and an outer sleeve member coaxially mounted onto said inner post member in a rotatable and telescoping manner, said outer sleeve member having internal threading corresponding to said external threading and weight receiving means to retain interchangeable weight disks thereon, whereby rotation of said outer sleeve member about said inner post member raises and lowers said outer sleeve member relative to said inner post member.

2. The device of claim 1, further comprising a bearing nut connected to said outer sleeve, where said internal threading is within said bearing nut, said bearing nut having a plural number of ball bearings positioned between said internal threading and said external threading of said inner post member.

3. The device of claim 2, where said outer surface of said outer sleeve member is providing with gripping means.

4. The device of claim 2, further comprising detent means attached to the upper end of said inner post member to halt rotation of said outer sleeve member.

5. The device of claim 4, where the outer diameter of said detent means is close to the inner diameter of said outer sleeve member.

6. The device of claim 1, where said external threading and said internal threading are semi-circular in configuration, and further comprising plural ball bearings positioned between said internal threading and said external threading.

7. An exercise device for exercising the muscles of the hands, wrists and forearms, the device comprising a vertically oriented inner post member and an outer sleeve member coaxially mounted onto said inner post member in a rotatable and telescoping manner, said inner post member attached to a base member to prevent rotation of said inner post member, said outer sleeve member having weight receiving means retaining interchangeable weight disks thereon, whereby rotation of said outer sleeve member about said inner post member raises and lowers said outer sleeve member and said weight disks relative to said inner post member.

8. The device of claim 7, where said inner post member has external threading, and further comprising a bearing nut connected to said outer sleeve, said bearing nut having internal threading and having a plural number of ball bearings positioned between said internal threading and said external threading of said inner post member.

9. The device of claim 7, where said outer surface of said outer sleeve member is providing with gripping means.

10. The device of claim 7, further comprising detent means attached to the upper end of said inner post member to halt rotation of said outer sleeve member.

11. The device of claim 10, where the outer diameter of said detent means is close to the inner diameter of said outer sleeve member.

12. The device of claim 8, where said external threading and said internal threading are semi-circular in configuration.

13. The device of claim 7, where said weight receiving means comprises a vertically oriented post.

* * * * *